US006086064A

United States Patent [19]

Biegelsen et al.

[11] Patent Number: 6,086,064

[45] Date of Patent: Jul. 11, 2000

[54] OBJECT POSITION/PRESENCE SENSOR AND METHOD FOR DETECTING OBJECT POSITION OR PRESENCE

[75] Inventors: David K. Biegelsen, Portola Valley; Warren Jackson, San Francisco, both of Calif.

[73] Assignee: Xerox Corporation, Stamford, Conn.

[21] Appl. No.: 09/161,533

[22] Filed: Sep. 28, 1998

[51] Int. Cl.[7] ..... B65H 7/02

[52] U.S. Cl. ..... 271/258.01; 271/260; 271/265.01

[58] Field of Search ..... 271/260, 265.01, 271/258.01

[56] References Cited

U.S. PATENT DOCUMENTS

| | | | |
|---|---|---|---|
| 2,900,468 | 8/1959 | Joy | 271/260 X |
| 2,994,528 | 8/1961 | Hull et al. | 271/260 |
| 3,285,608 | 11/1966 | Lyman | 271/260 X |
| 3,504,911 | 4/1970 | Silverberg | 271/260 |
| 3,773,321 | 11/1973 | Burroughs | 271/260 |
| 5,207,416 | 5/1993 | Soler | 271/260 X |

OTHER PUBLICATIONS

C.F. Malacaria, *A Thin, Flexible, Matrix–Based Pressure Sensor*, Sensors, pp. 102–104, Sep. 1998.

C. Haverty et al., *Enhancing Computer Game Joysticks with Smart Force Transducers*, Sensors, pp.92–95, Sep. 1998.

*Primary Examiner*—David H. Bollinger

*Attorney, Agent, or Firm*—Oliff & Berridge, PLC

[57] ABSTRACT

An object sensor includes at least one sensor device which is integrated with a fluid source. The object sensor includes a sensor housing having an object passage through which an object is moved. The object sensor further includes a fluid passage through which a flow of fluid passes. The object passage communicates with the fluid passage. A fluid source is positioned to generate a flow of fluid through the fluid passage. When an object, such as a paper sheet, moves through the object passage the object will obstruct or eclipse the flow of fluid produced by the fluid source and flowing through the fluid passage to diminish the flow of fluid. As a result, the impeded flow of fluid is sensed and one or more of a position, a presence and/or an absence of the object in the object passage is detected.

38 Claims, 6 Drawing Sheets

OBJECT POSITION/PRESENCE SENSOR AND METHOD FOR DETECTING OBJECT POSITION OR PRESENCE

BACKGROUND OF THE INVENTION

1. Field of the Invention

This invention relates to a sensor that detects a position of an object. More specifically, the invention relates to a sensor that senses the object position by detecting the presence or absence of a fluid flow.

2. Description of Related Art

Sensors are typically used to detect the position of various objects. A sensor may be positioned adjacent to a passage through which an object passes or adjacent to an area in which an object is positioned.

An illustrative example of an apparatus in which a sensor is used to detect an object's position is a photocopy device. Typically, in a photocopy device, multiple paper sheets are stored in a paper storage bin. Upon initiating a copying operation, a sheet is transported from the paper storage bin through various paths in the photocopy device. For example, the sheet is transported via a specified path to an area in which an image is reproduced on the paper. Thereafter, the sheet is transported via additional paths to a recovery bin from which the sheet can be retrieved.

Monitoring the position of each sheet as it passes through the various paths is integral to the operation of the photocopier. Various conventional sensors are currently used to detect the object's position in a conventional photocopier. For example, one conventional device for detecting the position of a paper sheet includes a light source and light sensor arrangement. This device may include a light emitting diode (LED) and a photodiode pair, wherein the light source emitted from the LED is eclipsed as the paper sheet moves between the light source and the light sensor.

SUMMARY OF THE INVENTION

However, this conventional device is subject to various disadvantages. For example, one disadvantage involves the use of transparent sheets in the photocopier. As a transparent sheet passes through pathways of the photocopier, it does not effectively eclipse the beam of light passing from the light source to the light sensor since the beam of light passes through the transparent sheet. As a result, the light source and light sensor arrangement cannot effectively determine the position of the transparent sheet.

A further disadvantage involves the effect of ambient light on the light source and light sensor arrangement. Paper pathways may exist in the photocopier which are exposed to ambient light or other light sources. The intensity of these light sources may vary. This varying the ambient light source may adversely effect the ability of the light sensor to detect the light source.

This invention provides an object sensor and sensing method that senses objects that are versatile and widely adaptable to a variety of situations in which detection of the position, presence or absence of an object in an area is necessary or desirable.

This invention provides an object sensor and sensing method that can effectively sense the position, presence or absence of an object which may have a variety of optical properties, including transparent properties.

This invention provides an object sensor and a sensing method using object sensors that are compact and positionable and usable in a variety of sections or areas within a device in which it is necessary or desirable to determine the presence, absence or position of an object.

In accordance with the invention, in one preferred embodiment, an object sensor is provided which includes one or more fluid flow property sensors, such as a membrane pressure sensor. The fluid flow property sensors are integrated with a fluid flow source, i.e., a fluid source, such as an air jet. More specifically, the object sensor includes a sensor housing having an object passage through which an object can be transported. The object sensor further includes a fluid passage through which the fluid, such as air, passes. The object passage communicates with the fluid passage. The fluid flow source is positioned to generate a flow of fluid through the fluid passage.

Each membrane pressure sensor preferably includes a flexible membrane and a sensor device. When an object is not present in the object passage, the unimpeded fluid flow passing from the fluid flow source impacts on and distends the flexible membrane. The unimpeded flow of fluid through the fluid passage will impinge on the flexible membrane with a given force. When an object, such as a paper sheet, moves through the object passage, the object will obstruct or eclipse the flow of fluid produced by the fluid flow source and flowing through the fluid passage. This diminishes or impedes the flow of fluid to the flexible membrane. As a result, the impeded flow of fluid results in a change in the force on the flexible membrane. A detector, i.e., the fluid sensor, is positioned on the flexible membrane. As the force on the flexible membrane changes, the stress or strain on the detector changes. As a result, the presence, or absence, of the object in the object passage at the fluid flow passage is detected. By determining the amount of change on the detector, the amount by which the fluid flow has been impeded can be determined. The determined amount by which the fluid flow has been impeded provides an indication of the position of the edge of the object relative to the fluid flow passage. Thus, the relative position, presence or absence of the object at the fluid flow passage can be do determined.

These and other features and advantages of this invention are described in or are apparent from the following detailed description of the preferred embodiments.

BRIEF DESCRIPTION OF THE DRAWINGS

The preferred embodiments of this invention will be described in detail, with reference to the following figures, wherein.

DETAILED DESCRIPTION OF PREFERRED EMBODIMENTS

Figure 1:
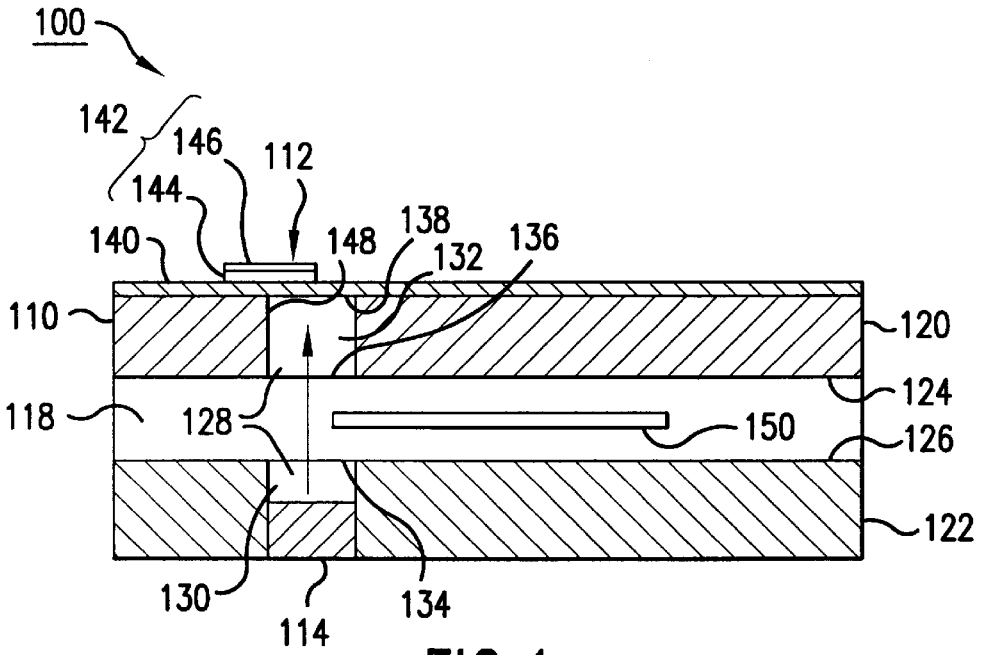
FIG. 1 is a side cross-sectional view showing an object sensor in accordance with an embodiment of the invention.

It should be appreciated that any known or later developed fluid can be used in the object sensor in accordance with the invention. The only limitation on the fluid is that the fluid cannot damage or pollute either the object sensor, the sensed object, or any of the surrounding elements of the device in which the object sensor is located or that device's environment. Similarly, it should be appreciated that any known or later developed fluid flow sensor or pressure sensor or other type of sensor can be used to detect the amount, presence or absence of the fluid flow in the fluid flow passage. The only limitation on the fluid sensor is that it be able to accurately detect the presence or absence of the fluid flow, and; if desired, accurately detect the amount of fluid flow.

It should further be appreciated that the object sensor according to this invention can be used to sense the position or presence/absence of any type of object that can be transported through the object passage described below to obstruct, block or occlude the fluid flow across the object passage. Thus, so long as the fluid flow is sufficiently altered by the object traveling through the object passage such that the altered fluid flow can be sensed by the particular sensor used, the position and/or the presence or absence of any object can be sensed by the sensor and sensing method according to this invention.

In the following exemplary description of some embodiments of the sensor and sensing method according to this invention, the fluid is air and the fluid sensor is a membrane pressure sensor. However, as set forth above, it should be appreciated that the sensor and sensing method according to this invention are not limited to air and membrane pressure sensors. Similarly, in the following exemplary description of some embodiments of the object sensor and sensing method according to this invention, the object is a paper sheet and the object sensor is positioned within an image forming device, such as a printer, a photocopier, a facsimile or the like. However, as set forth above, it should be appreciated that the object sensor and sensing method of this invention are not limited to sensing paper or being positioned in or used with an image forming device.

Thus, the fluid could be another gas, such as any gaseous-state element, like oxygen, nitrogen, helium, hydrogen, neon, argon or the like, any gaseous-state molecular compound or mixture, like carbon dioxide, steam, methane or other gaseous hydrocarbon or hydrocarbon vapors, an organic gas, such as ether, or the like. Similarly, the fluid could be a liquid, such as any liquid-state element, like mercury, any liquid-state molecule, compound or mixture, like water, liquid hydrocarbon, such as mineral or vegetable oil, organic liquid, such as acetone or formaldehyde, or the like. Those skilled in the art will appreciate that the appropriate fluid to be used in a particular embodiment of the object sensor and sensing method according to this invention will depend on the sensing environment, fluid sensing device, object to be sensed and the like.

Similarly, the fluid sensing device could be a fluid flow sensor, such as a pitot tube, an anemometer, a hot-wire anemometer or the like, a fluid pressure sensor, such as a barometer, a membrane pressure sensor or the like, an indirect fluid flow sensor, such as an accelerometer attached to a flexible membrane deformable by the fluid flow, a sensor which detects another environmental property that depends on the fluid flow, such as an oxygen sensor, an optical sensor, a capacitor that uses the fluid as a dielectric material, or the like. Those skilled in the art will appreciate that the appropriate sensing device to be used in a particular embodiment of the sensor and sensing method according to this invention will depend on the sensing environment, fluid, object to be sensed, and the like. In particular, the thin-film matrix pressure sensors disclosed in co-pending U.S. patent applications Ser. No. 09/161,532 and Ser. No. 09/161,534, now U.S. Pat. No. 6,032,536, filed herewith and incorporated by reference in their entirety, can be used as the fluid flow sensor.

Finally, some examples of objects to be sensed include paper and other recording media, sheet-like materials, such as paper webs, sheet metals, ribbons, and the like, and even screen-like materials and other objects having holes or passages through which the fluid could flow, if the material or object is nonetheless able to sufficiently disturb, reduce or block the fluid flow such that the presence/absence and/or position of the material or object is detectable.

Thus, the object sensor and sensing method according to this invention are usable with a digital or analog photocopier, a printer, a facsimile machine, a document handler, a collator, an offset printer, a newspaper printer, a paper making machine, a sheet metal rolling machine, a sheet metal annealing machine, a sheet metal cooling device, an extruder, a conveyor system, or a materials transport system.

FIG. 1 shows an object sensor 100 in accordance with a preferred embodiment of the invention. The object sensor 100 may be positioned in any device in which it is necessary to detect the presence, absence or position of an object. Illustratively, the object sensor 100 in accordance with the invention may be utilized in coffee machines or in conjunction with a robotic arm to determine a position of the object. Alternatively, the object sensor 100 may be positioned in an area of a photocopier in which it is necessary to sense the position of the object, such as a sheet of paper. Such an area of a photocopier may be a registration module or an output tray, for example. However, it should be appreciated that, as outlined above, the object sensor 100 can be used anywhere a presence or absence of an object, or a position of the object, needs to be determined, so long as the object sensor 100 can be provided with the required fluid flow.

The object sensor 100 includes at least one fluid sensor 112 which is integrated with a fluid flow source 114. In the embodiment shown in FIG. 1, the fluid sensor 112 is preferably a membrane pressure sensor and includes a sensor device 142 and a flexible membrane 140, i.e., a pressure sensor. The fluid flow source 114 is preferably an air jet, such as a fan or a pulsed air source such as coil driven or piezoactivated membrane that provides a net fluid flow.

The object sensor 100 includes a sensor housing 110 having an object passage 118 through which the object to be sensed can be transported. The sensor housing 110 includes a sensor portion 120 and a jet portion 122. The object sensor 100 further includes a fluid passage 128 through which the flow of air passes. The object passage 118 is connected to and communicates with the fluid passage 128. The fluid passage 128 includes an inflow passage 130 and an outflow passage 132, as shown in FIG. 1. The inflow passage 130 and the outflow passage 132 are aligned with one another.

The object passage 118 has a fluid outflow surface 124 and a fluid inflow surface 126. The term "fluid outflow surface," as used herein, pertains to the flow of fluid used for sensing and denotes a surface of the object passage in which an aperture is formed; and "fluid flows out" of the object passage through this aperture. Also, the term "fluid inflow surface, as used herein, denotes a surface of the object passage, which opposes the fluid outflow surface; in which another aperture is formed; and through which fluid flows into the object passage from this another aperture. Fluid flows into the object passage from the inflow passage 130 through the fluid inflow surface 126. Fluid flows out of the object passage through the fluid outflow surface 124 and into the outflow passage 132.

The fluid outflow surface 124 defines one surface of the object passage 118 and the fluid inflow surface 126 defines an opposite surface of the object passage 118. The dimensions of the object passage 118 may be any dimensions suitable to allow the object to pass through the object passage 118. For example, the object passage 118 may be dimensioned to accommodate a sheet of paper.

The perimeters of the inflow passage 130 and the outflow passage 132 may be of any suitable shape, such as square or circular. However, a circular shape may reduce the number of vortexes in the fluid flow occurring in the fluid passage 128, relative to a square shape. As a result, the sensitivity and accuracy of the object sensor 100 having a circular fluid passage 128 may be improved, compared to an object sensor 100 having a square fluid passage 128. Further, an object sensor constructed with a long narrow slit, from which a fluid flow is emitted, located opposite a similarly dimensioned fluid sensor may be useful for continuous detection of paper motion. However, it should be appreciated that the shape of the perimeters of the inflow and outflow passages 130 and 132 is an independent feature and the object sensor and sensing method according to this invention can be used with any fluid passage 128 having any shape.

The inflow passage 130 is formed within and extends through the jet portion 122. The inflow passage 130 connects with the object passage 118 at an exit end 134 of the inflow passage 130. The outflow passage 132 is formed within and extends through the sensor portion 120. The outflow passage 132 connects with the object passage 118 at an entry end 136 of the outflow passage 132. The outflow passage 132 includes a terminal end 138. The terminal end 138 of the outflow passage 132 may be closed, as discussed further below.

The fluid flow source 114 is positioned to generate a flow of fluid through the fluid passage 128. The flow of fluid may be created using any suitable arrangement which will provide a suitable fluid velocity. As shown in FIG. 1, the fluid flow source 114 generates a flow of air. Preferably, in this embodiment, the fluid flow source 114 is one or more air jets. The fluid sources may be continous or pulsed. The latter may be of use to eliminate interferrence from other fluid sources. The velocity of the fluid flow generated by the fluid flow source 114 will vary depending on the specific application. However, in this embodiment, the velocity of the air flow generated by the fluid flow source 114 must be compatible with the specific membrane pressure sensor used as the fluid sensor 112. The dimensions of the fluid flow source 114 will also vary depending on the specific application. In this embodiment, the air jets forming the fluid flow source 114 may be 0.25–1 mm in diameter.

As shown in FIG. 1, the fluid sensor 112 is positioned adjacent the terminal end 138 of the outflow passage 132. In this embodiment, the membrane pressure sensor forming the fluid sensor 112 includes a flexible membrane 140 and a sensor device 142. The flexible membrane 140 is positioned over the terminal end 138 of the outflow passage 132 to close the terminal end 138. The flexible membrane 140 may be constructed of any compliant elastic film which will elastically deform in response to a pressure exerted by the flow of air in the outflow passage 132 due to the fluid flow source 114. The flexible membrane 140 may be a compliant elastic film, such as silicon, silicone or a polymer sheet, for example. The flexible membrane 140 may be laminated onto the sensor portion 120, as shown in FIG. 1. The sensor device 142 is positioned over the flexible membrane 140. The sensor device 142 may be any known device or apparatus that can detect an effect of the fluid flow from the fluid flow source 114 on the flexible membrane 140. Preferably, the sensor device 142 is a piezo-resistive device whose resistance changes as the fluid flow causes the flexible membrane 140 to deform from a rest position. An alternative is a electrete membrane structure such is used in an electrete microphone that generates an electrical response upon a burst of fluid from a pulsed air source. Alternatively, the sensor device 142 can be any other device capable of sensing strain in the flexible membrane, or an accelerometer, capacitive sensor or other device that senses movement of the flexible membrane, or any other known or later developed sensor device capable of detecting deformation of the flexible membrane 140 in response to a pressure exerted by the fluid flow generated by the fluid flow source 114.

As shown in FIG. 1, the sensor device 142 includes a piezoresistive layer 144 and a metal contact layer 146. The piezoresistive layer 144 is deposited and patterned over the flexible membrane 140. The metal contact layer 146 is formed over the piezoresistive layer 144. The metal contact layer 146 is electrically connected to the piezoresistive layer 144 such that the resistance of the piezoresistive layer 144 may be determined, as is well known in the art. The resistance of the piezoresistive layer 144 changes depending on the strain placed on the piezoresistive layer 144. The strain in the piezoresistive layer 144 changes depending on changes in dimension of the flexible membrane 140 as it is deformed from a rest position by the pressure exerted by the fluid flow in the outflow passage 132.

In operation, when an object is not present in the object passage 118, the fluid flow passing through the outflow passage 132 is unimpeded and impacts the flexible membrane 140 to deform the flexible membrane 140 from its rest position. As a result, the unimpeded fluid flow through the outflow passage 132 will impinge on the flexible membrane 140 at a first magnitude. The flexible membrane 140 may be any suitable flexible material. When an object 150, such as a paper sheet, moves through the object passage 118, as shown in FIG. 1, the object 150 will come to a position at which it is positioned between the inflow passage 130 and the outflow passage 132. As a result, the object 150 will obstruct or impede the fluid flow produced by the fluid flow source 114 and flowing through the inflow passage 130, diminishing the fluid flow flowing through the outflow passage 132 and impinging on the flexible membrane 140. As a result, the impeded fluid flow through the outflow passage 132 will impinge on the flexible membrane 140 at a second magnitude, which is less than the first magnitude.

The diminished fluid flow results in a change in the amount of deformation in the flexible membrane 140 due to both the reduced force of the fluid flow on and the resilience of the flexible membrane 140. The sensor device 142 is positioned upon the flexible membrane 140, as shown in FIG. 1. Also, it should be recognized that alternatively the sensor device 142 could be positioned within the flexible membrane 140, or actually form a portion of the flexible membrane. Illustratively, a sensor device can be a poezoresistive sensor including a doped region within a silicon membrane. The sensor device 142 senses the change in the amount of deformation of the flexible membrane 140. Specifically, the electrical resistance of the piezoresistive layer 144 will change. As a result, the sensor device 142 can effectively determine the position and/or the presence or absence of the object 150 passing through the object passage 118. For example, the object sensor 100 may be used to detect a portion of a sheet of paper. The portion of the paper sheet detected may be the leading edge, the trailing edge, or one or both sides edge of the paper sheet. Accordingly, the sensor device 142 in accordance with the invention does not only measure whether fluid is flowing in the outflow passage 132, such as by measuring whether pressure is exerted on the sensor device 142 due to the fluid flow through the outflow passage 132. Rather, the sensor device 142 in accordance with the invention measures the change in fluid flow in the outflow passage 132, such as by measuring the change in pressure exerted on the sensor device 142 due to the changed force exerted by the fluid flow through the outflow passage 132.

As described above, an object disrupts the fluid flow from the fluid flow source 114 into the outflow passage 132 and correspondingly changes the resistance of the piezoresistive layer 144. This arrangement may be used to infer the edge position of the object, such as an edge position of a sheet of paper. Commercially available paper may have irregular edges. However, the adverse effect of irregular edges of paper sheets may be reduced by measuring the same edge of the paper sheet, or more precisely, the same point on the paper sheet.

An array of the fluid flow sources 114 in conjunction with respective fluid sensors 112 may be used to obtain multiple readings of an object's position and/or presence or absence, such as multiple readings of the object's edge locations at multiple times. Such an array is discussed in the incorporated Ser. No. 09/161,534 application. Also, such an array of sensor devices is discussed below. Additionally, while the object 150 may be preferably vertically centered between the exit end 134 of the inflow passage 130 and the entry end 136 of the outflow passage 132, such positioning is not necessary. The object sensor 100 may be effectively operated when the object 150 is positioned closer to the entry end 136 of the outflow passage 132, or alternatively closer to the exit end 134 of the inflow passage 130. However, if the distance between the fluid flow source 114 and both the sensed object 150 and the fluid sensor 112 is substantial, broadening out of the fluid flow generated by the fluid flow source 114 may occur. Such broadening out of the fluid flow would effect the resolution of the object sensor 100.

As shown in FIG. 1, the outflow passage 132 is defined by a circumferential surface 148. It should be appreciated that the sensor device 142 and the flexible membrane 140 can be positioned within the circumferential surface 148 of the outflow passage 132. However, positioning the sensor device 142 and the flexible membrane 140 over the circumferential edge of the outflow passage 132 to form a bridge portion is preferable, because this results in the concentrated deformation of the flexible membrane 140. Such concentrated deformation is readily sensed by the piezoresistive layer 144 and will provide a sensitive arrangement. Furthermore, selecting materials for both the piezoresistive layer 144 and the flexible membrane 140 is simplified, because the criticality of highly specific mechanical properties will be reduced.

Figure 2:
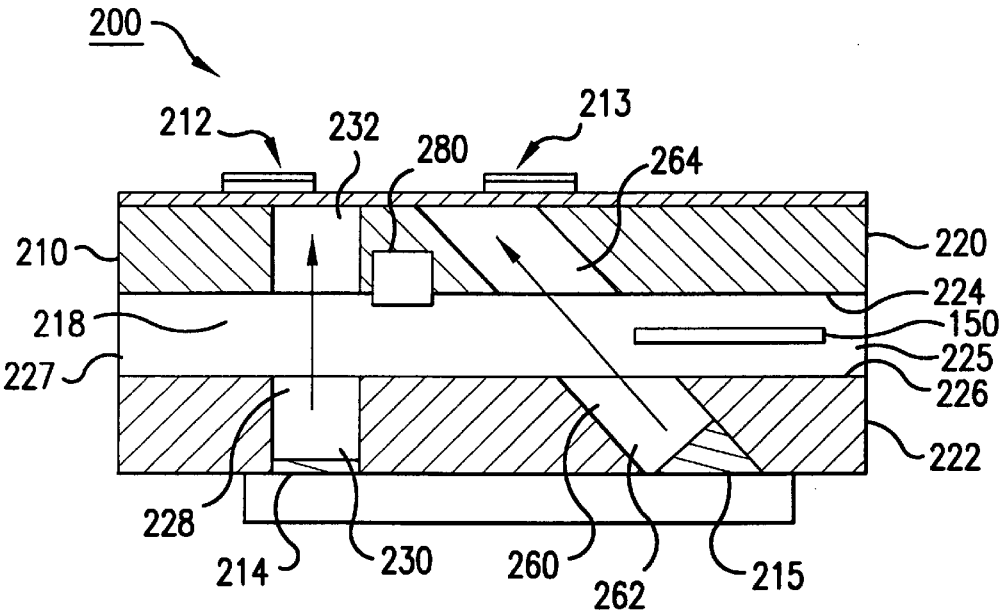
FIG. 2 is a side cross-sectional view showing an object sensor in accordance with another embodiment of the invention.

FIG. 2 shows another embodiment of an object sensor 200 in accordance with the invention. The object sensor 200 shown in FIG. 2 includes a sensor housing 210 including an object passage 218 having an input end 225 and an output end 227. The sensor housing 210 includes a sensor portion 220 and a jet portion 222. The object sensor 200 includes a first fluid passage 228 which provides for fluid flow from a first fluid source 214 to a first fluid sensor 212. Further, the object sensor 200 includes a second fluid passage 260 which provides for fluid flow from a second fluid source 215 to a second fluid sensor 213. The object passage 218 is defined by a fluid inflow side 226 and a fluid outflow side 224. Accordingly, in this embodiment of the invention, the object sensor 200 includes a plurality of fluid sensors 212 and 213 which are integrated with a plurality of fluid flow sources 214 and 215, respectively.

For example, an image forming engine 280 can be positioned between the first fluid passage 228 and the second fluid passage 260. The image forming engine 280 may be any known arrangement, such as a photosensitive drum or an ink cartridge arrangement, capable of reproducing an image on the object 150 as the object 150 passes by the image forming engine 280.

A first longitudinal axis extends through the center of a first inflow passage 230 and a first outflow passage 232 of the first fluid passage 228. A second longitudinal axis extends through the center of a second inflow passage 262 and a second outflow passage 264 of the second fluid passage 260. The first longitudinal axis is positioned perpendicular to the object passage 218. However, as shown in FIG. 2, the second longitudinal axis is positioned at an angle to the object passage 218.

FIG. 2 demonstrates a further aspect of the invention. Because the second fluid passage 260 is positioned at an angle to the object passage 218, the fluid flow through the second fluid passage 260 will tend to accelerate the object 150, as the object 150 passes through the object passage 218. For example, it is conventionally known to use air jets to accelerate a paper sheet. In one preferred embodiment of the invention shown in FIG. 2, the second fluid source 215 may be an air jet source that is smaller than an air jet source that is conventionally used to accelerate a paper sheet. As shown in FIG. 2, the second fluid source 215 may be used both to sense the position and/or presence or absence of a sheet of paper and conventionally to accelerate a paper sheet. Further, as shown in FIG. 2, when the first and second fluid sources 214 and 215 are air jets, a single fan unit may be used to provide the two fluid sources, as shown in FIG. 2. However, various other arrangements may be used to create the flow of fluid through the fluid passages 228 and 260, as discussed further below.

Figure 3:
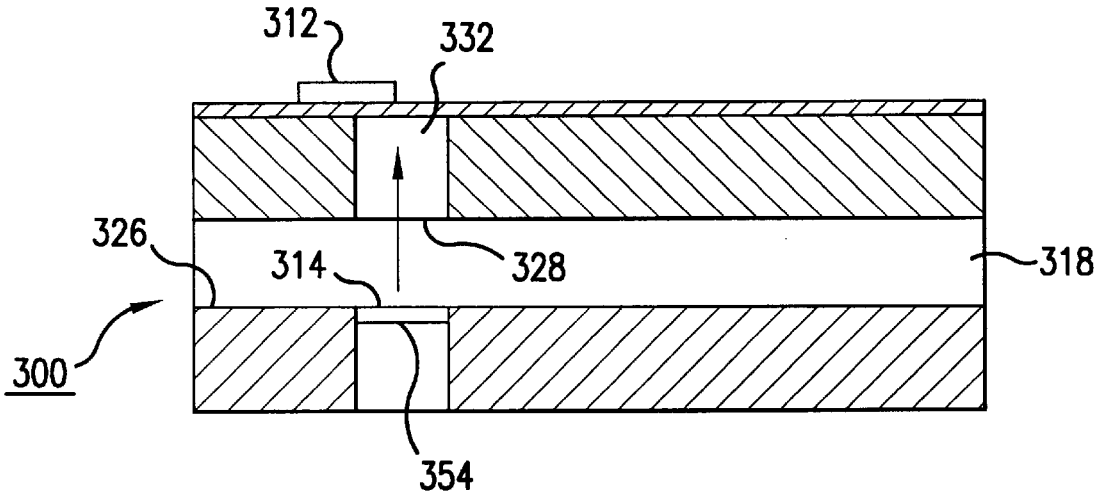
FIG. 3 is a side cross-sectional view showing an object sensor in accordance with a further embodiment of the invention.

FIG. 3 shows a further embodiment of the invention. FIG. 3 shows an object sensor 300 using an alternative fluid flow source 314 positioned to generate a fluid flow through a fluid passage 328. As described above, the fluid flow may be created using any suitable arrangement which will provide a suitable flow velocity. As shown in FIG. 3, a piezoelectric membrane 354 may be used to create the fluid flow. Specifically, by pulsing the piezoelectric membrane 354, a pulsed fluid flow will be generated. When there is no object 150 in the object passage 318 obstructing the pulsed fluid flow from the piezoelectric membrane 354, the fluid will move freely through an outflow passage 332 and to a fluid sensor 312 and impinge on the fluid sensor 312. However, the position and/or presence or absence of an object 150 in the object passage 318 adjacent the piezoelectric membrane 354 obstructs the fluid flow. This obstruction is sensed by the fluid sensor 312.

An alternative arrangement is a vaporizing arrangement that would vaporize a fluid and direct the vaporized fluid to the fluid sensor 312. For example, water may be vaporized to generate a pressure that is detected by the fluid sensor 312. This vaporization technology is commonly used in conjunction with ink in a conventional bubble jet printer.

Both the piezoelectric membrane 354 and the vaporizing arrangement will generate a pulsed fluid flow. The output of the fluid sensor 312 can be read only in response to the pulsed fluid flow. That is, the output of the fluid sensor 312 is read simultaneously with the pulsed fluid flow. In this manner, the object sensor 300 can discriminate against background fluid flows.

Figure 4:
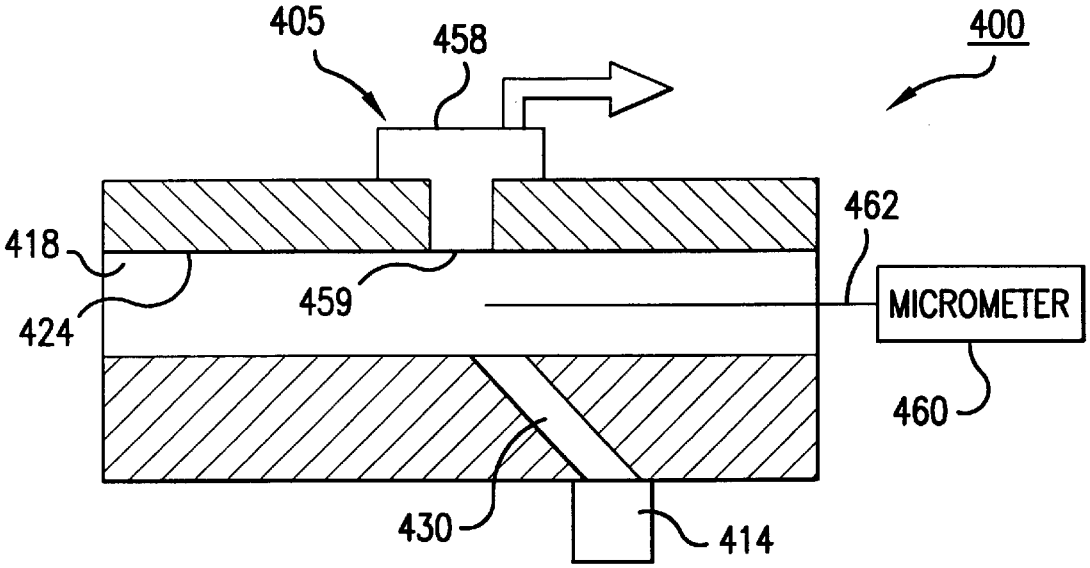
FIG. 4 is a side cross-sectional view showing an experimental setup of a sensor in accordance with the invention.

FIG. 4 shows an experimental setup 400 including an object sensor 405 in accordance with the invention. The experimental setup 400 tests the positional accuracy of the output of the object sensor 405. As shown in FIG. 4, one commercially available sensor which may be used as the fluid sensor is the commercially available Fujikura membrane pressure sensor 458 having a silicon membrane and piezoresistive elements. The sensitivity provided by the Fujikura membrane pressure sensor 458 is adequate for paper edge sensing applications. In the experimental setup 400, an air jet 414 generates a flow of air towards the Fujikura membrane pressure sensor 458 through an inflow passage 430. A micrometer 460 measures the actual position of the paper sheet 462. The Fujikura membrane pressure sensor 458 generates an output signal that varies between limits as the shadow of the paper edge traverses the Fujikura membrane pressure sensor 458. Using a low pass filter having a cutoff of 100 Hz and a DC digital volt meter (DVM) (not shown), the output of the Fujikura membrane pressure sensor 458 may be read as a function of the paper position determined by the micrometer 460.

Figure 5:
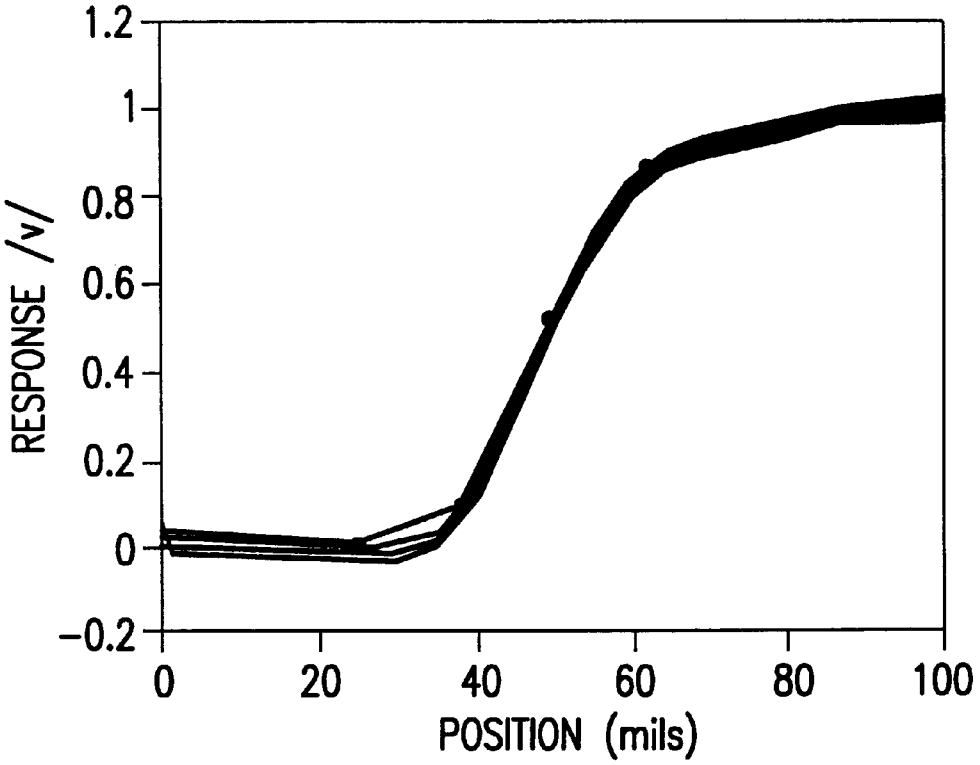
FIG. 5 is a graphical representation showing output of a sensor in relation to a position of a paper sheet using the experimental setup shown in FIG. 4 in accordance with the invention.

FIG. 5 shows the relationship between the signal output of the Fujikura membrane pressure sensor 458 and the position of the paper sheet 462 as measured by the micrometer 460. The signal output is a function of the position of the object 462. Further, FIG. 5 shows the resolution of the object sensor 405. As shown in FIG. 5, the experimental setup 400 is most sensitive between 40 and 60 mils. From the data shown in FIG. 5, the edge position can be determined to better than 0.001" when the edge is approximately centered in the flow of air from the air jet 414. The experimental setup 400 demonstrates that an array of the fluid flow sources and fluid sensors in accordance with the invention can provide time stamps for the arrival of an edge of an object relative to each of the pressure sensors of the array. Tests have determined that using the experimental setup 400 shown in FIG. 4, the edge of the sheet of paper 462 can be determined to closer than 25 microns (1 mil) when the air jet source 414 aimed at the sensor is obstructed or eclipsed by a moving edge of the sheet of paper 462.

FIG. 4 further shows that it is not necessary for the object sensor 405 to include an outflow passage, as in FIG. 1. Rather, for example, a sensing surface 459 of the membrane pressure sensor 458 may be positioned flush with the fluid outflow surface 424 of the object passage 418 opposite to the air flow passage 430, as shown in FIG. 4. Alternatively, the membrane sensor may have a passage up to the sensor membrane as in the Fujikura sensor. Additionally, it should be recognized that a wide variety of shapes and structures may be used as membranes. For example, a membrane can also be a cantilevered film or a beam.

Additionally, it is not necessary for the object sensor 405 to include the inflow passage 130, as in FIG. 1. As shown in FIG. 3, for example, in the object sensor 300, the surface of the air jet source 314, i.e., the piezoelectric membrane, is flush with the fluid inflow surface 326 of the object passage 318 opposite the outflow passage 332.

Figure 6:
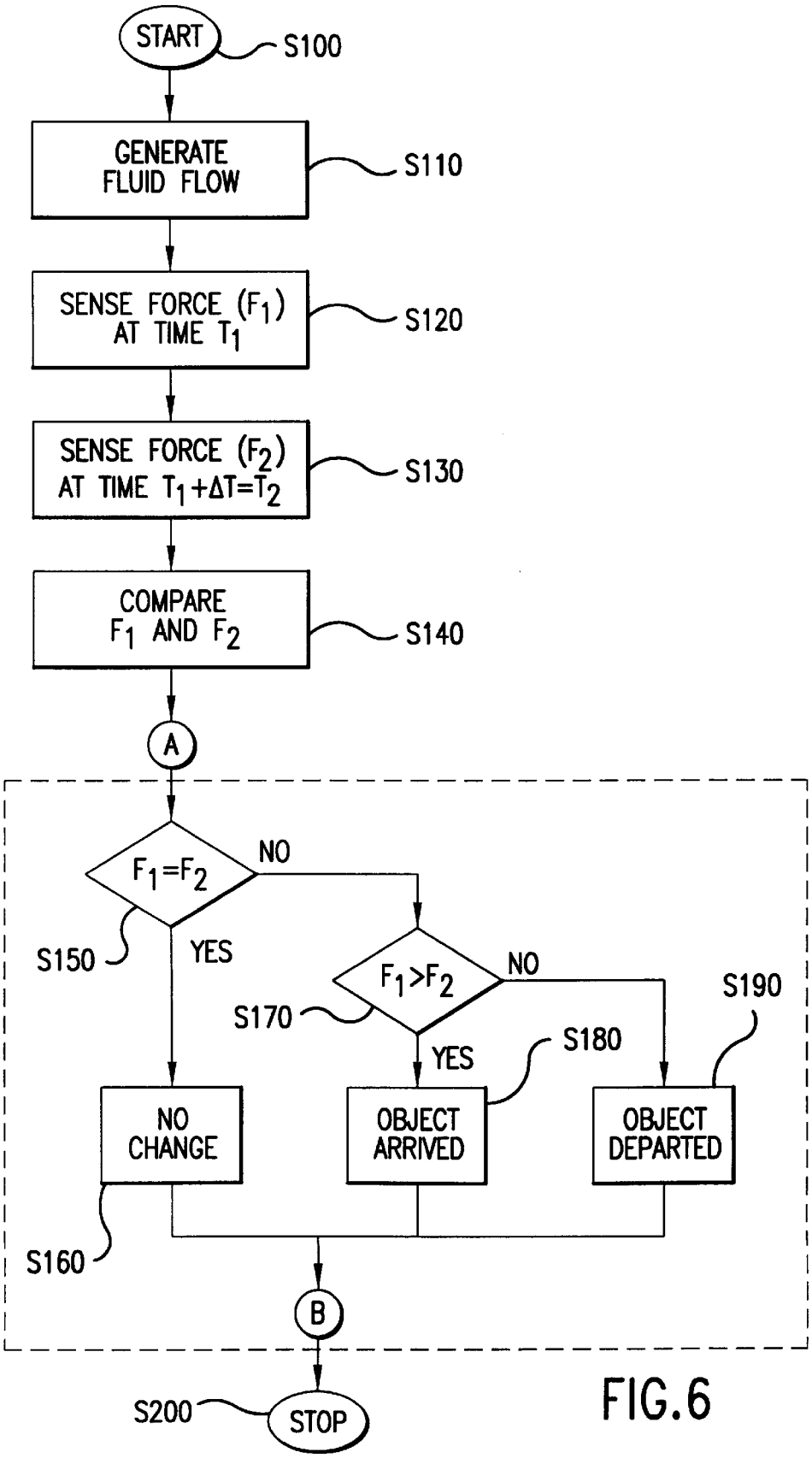
FIG. 6 is a flowchart outlining one preferred embodiment of an object detection method in accordance with the invention.

FIG. 6 is a flowchart outlining one preferred method for detecting an object according to this invention. Beginning in step S100, control continues to step S110, where a fluid flow is generated. Then, in step S120, a first force F1 of the fluid flow is sensed at a first time T1. Next, in step S130, a second force F2 of the flow is sensed at a second time T1, where $T2=T1+\Delta T$. Control then continues to step S140.

In step S140, the first force F1 is compared to the second force F2. FIG. 6 shows one alternative M1 comprising steps S150–S190 for comparing F1 and F2. Specifically, in step S150, the result of the comparison of step S140 is checked to determine if the first force F1 is equal to the second force F2. If the first force F1 is equal to the second force F2, control continues to step S160. Otherwise, control continues to step S170.

In step S160, because the first force F1 is equal to the second force F2, an indication is generated indicating that there has been no change in the presence or absence of an object. Control then jumps to step S200.

In contrast, in step S170, the result of the comparison is checked to determine if the first force F1 is greater than the second force F2. If so, control continues to step S180. Otherwise, control jumps to step S190. In step S180, because the first force F1 is greater than the second force F2, an indication is generated that an object is present, and has arrived within the last $\Delta T$ interval. Specifically, the object has arrived and obstructed the fluid flow to decrease the flow of fluid. Control then jumps to step S200. In contrast, in step S190, an indication is generated that an object is not present, and has departed within the last $\Delta T$ interval. Specifically, the object has departed and the fluid flow is no longer obstructed. Control then continues to step S200. In step S200, the control routine stops.

The process outlined in FIG. 6 in accordance with the invention is based upon an assumption that there are no other external variable factors that would effect the first and second forces F1 and F2. However, in a system in which the invention may be used, it should be recognized that there will probably be external variable factors, and that these factors may very well effect the first force F1 and/or the second force F2. Accordingly, if such external factors are present, the process outlined in FIG. 6 should be modified. Specifically, correction coefficients may be associated with the first and/or second forces F1 and/or F2 to adjust the first and/or second force F1 and F2 to correct and/or compensate for any external factors.

By appropriately setting or controlling the interval $\Delta T$, the resolution of the object sensor can be controlled. Furthermore, by factoring in the known or assumed velocity of the sensed object, the position of the leading or trailing edge relative to the object sensor can be determined and/or the interval $\Delta T$ controlled. Moreover, by factoring in the difference between the first and second forces F1 and F2, the resolution of the position determination can be improved. Specifically, the sensitivity of the object sensor can be adjusted to provide optimum sensitivity in the pressure range between F1 and F2.

It should also be appreciated that, while the variables F1 and F2 are used to represent forces sensed by a pressure sensor in the above-outlined description of FIG. 6, the variables F1 and F2 can alternatively represent a fluid flow velocity, a fluid flow volume flow rate, or other flow-dependent property of the particular fluid being used, as outlined above prior to the description of FIG. 1.

Figure 7:
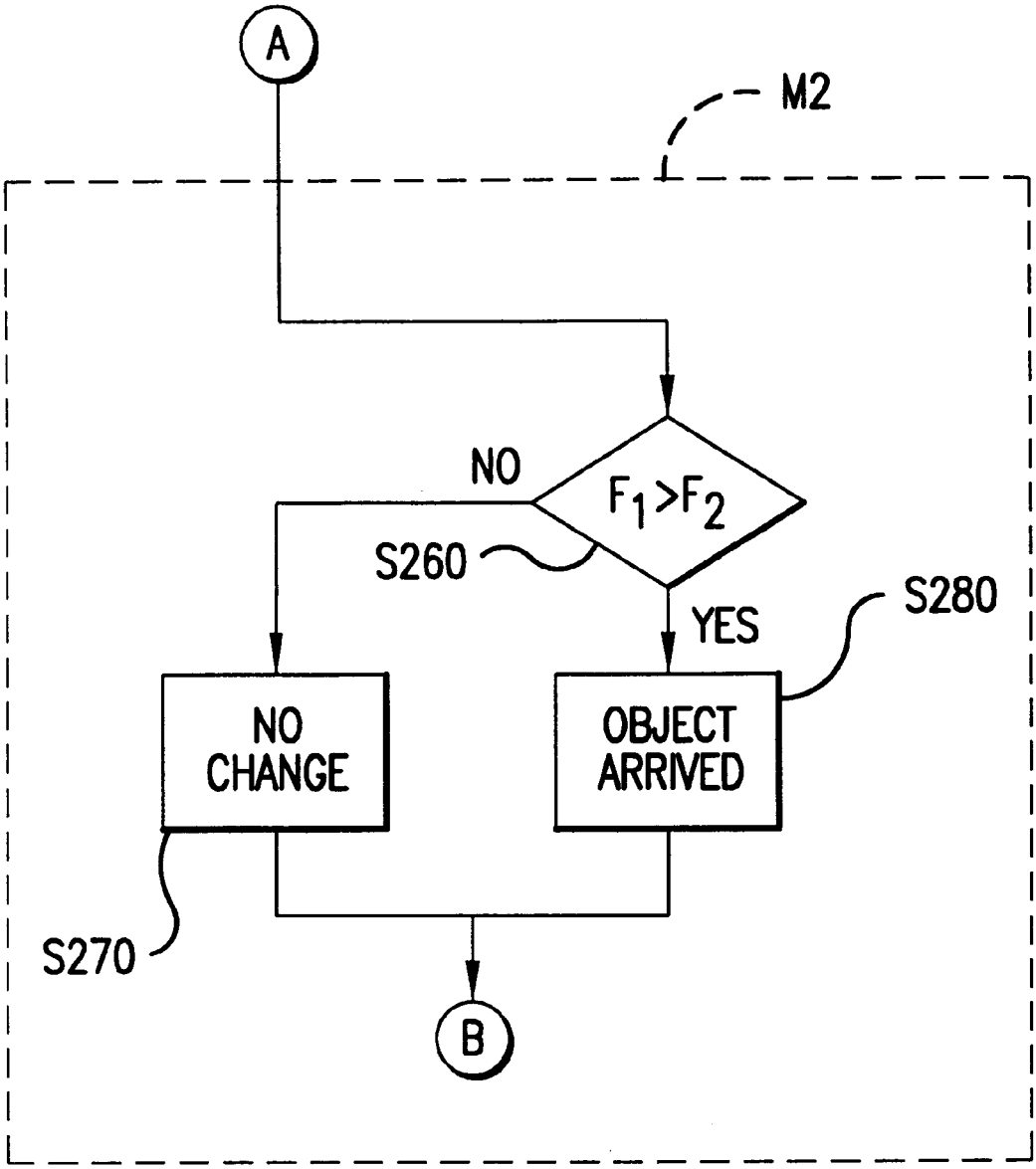
FIG. 7 is a flowchart outlining an alternative embodiment in accordance with the invention to steps S150–S190 of the object detection method of FIG. 6.
Figure 8:
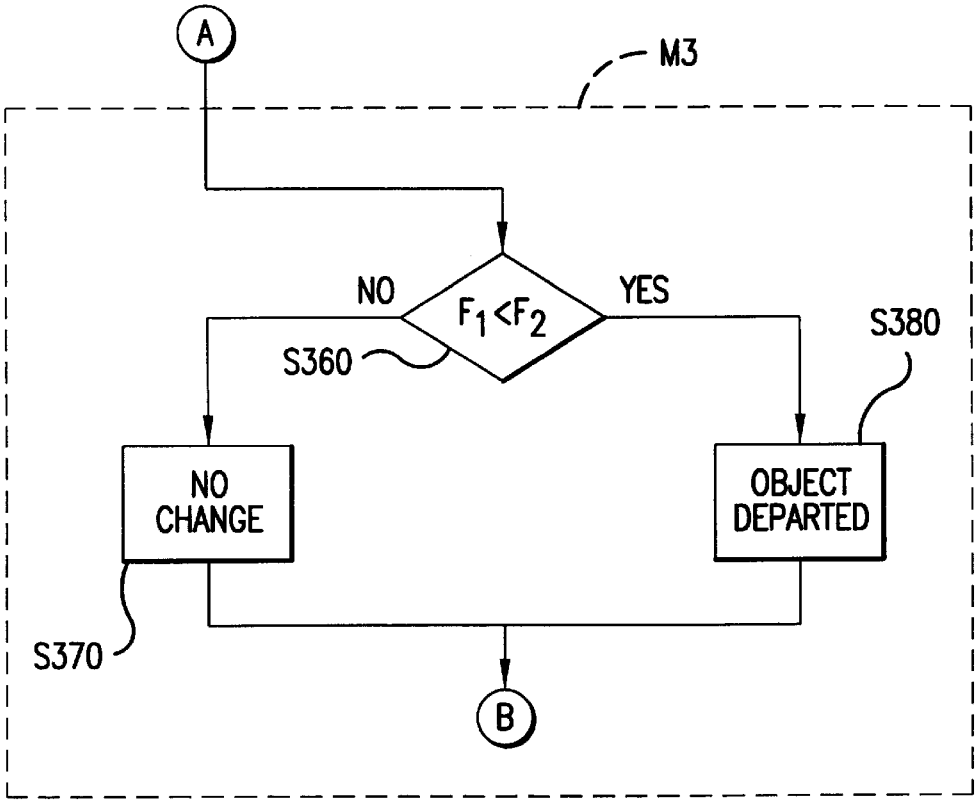
FIG. 8 is a flowchart outlining another alternative embodiment in accordance with the invention to steps S150–S190 of the object detection method of FIG. 6.

It should be appreciated that alternatives to steps S150–S190 can also be used. FIGS. 7 and 8 outline additional sensing methods M2 and M3 for comparing the variables F1 and F2. The alternatives outlined in FIGS. 7 and 8 illustrate variations of steps S150–S190 shown in FIG. 6 to provide different manners for comparing the variables F1 and F2. For example, as shown in FIG. 7, if only determining the arrival or position of the leading edge were necessary or desired, control could jump directly from step S140 to step S260. In this case, in step S260, if F1 is greater than F2, control jumps from step S260 to step S280. Otherwise, control would continue to step S270. In step S270, an indication is generated indicating there is no change in the arrival or position of the leading edge relative to the object sensor. In step S280, an indication is generated that there is a change in the arrival or position of the object and that the object has arrived relative to the object sensor. More specifically, an indication is generated that a leading edge of an object has arrived and obstructed the fluid flow so as to decrease the first F1 sensed to F2. Consequently, departure of the object would not be detected. Control then jumps from both steps S270 and S280 to step S200.

Similarly, as shown in FIG. 8, if only detecting the departure or position of the trailing edge were important, control would jump from step S140 directly to step S360. In step S360, the comparison of F1 and F2 is checked to determine if F1 is less than F2. If so, control continues from step S360 to step S380. Otherwise, control jumps to step S370. In step S370, an indication is generated indicating there is no change in the departure or position of the trailing edge relative to the object sensor. In step S380, an indication is generated that there is a change in the departure or position of the object and that the object has departed relative to the object sensor. More specifically, an indication is generated that a trailing edge of an object has departed and left the fluid flow unobstructed so as to increase the first F1 sensed to F2. Control jumps from both steps S370 and S380 to step S200. Consequently, departure of the object would not be detected. Another desirable utility is for closed loop feedback control of an edge. Thus, the object is controlled to maintain the object at a desired position that causes the sensor to output a specified or desired value, such as, for example, the mid-point of the curve shown in FIG. 5.

Furthermore, combinations, revisions and/or alterations to these methods will be apparent to those skilled in the art depending on whether the mere presence or absence of the object is important, or whether the position of one or more edges needs to be detected, and whether the arrival and/or departure of the particular edges needs to be detected.

In any such method, either the current reading of the fluid sensor is compared to a previous reading, as set forth above, or the current reading is compared to one or more threshold values. Each of the one or more threshold values can be predetermined or dynamically revised or set as the objects passing through the object passage are sensed. The threshold values can be predetermined based on properties of the object sensed, for example, the weight of the object. As the weight of a sensed object decreases, the threshold value may be decreased so as to not affect movement of the object through the object passage. As the threshold value decreases, the sensitivity of the object sensor must increase. Accordingly, an object sensor for sensing a paper sheet would require greater sensitivity than an object sensor for sensing the presence, position or absence of sheet metal.

While this invention has been described in conjunction with specific embodiments outlined above, it is evident that many alternatives, modifications and variations may be apparent to those skilled in the art. Accordingly, the preferred embodiments of the invention as set forth herein are intended to be illustrative, not limiting. Various changes may be made without departing from the spirit and scope of the invention.

What is claimed is:

1. An apparatus that senses at least one of a position, a presence or an absence of a moving object, comprising:

a housing defining an object passage through which the moving object is movable;

a fluid source that provides a fluid flow across the object passage;

a sensor device that generates a first signal indicative of an amount of a property at a first time, the property being dependent on an amount of the fluid flow, the first signal indicative of a first amount of the fluid flow;

a sensor device that generates a second signal indicative of an amount of a property at a second time, the property being dependent on an amount of the fluid flow, the second signal indicative of a second amount of the fluid flow; and a comparator that compares the first signal and the second signal to determine at least one of the position, the presence or the absence of the moving object;

wherein, when the moving object is in an obstructing position relative to the fluid source and the sensor device, the fluid flow decreases.

2. The apparatus according to claim 1, further including a fluid passage through which the fluid flow passes, the fluid passage communicating with the object passage.

3. The apparatus according to claim 2, wherein the fluid passage communicates with the object passage to define first and second sides of the object passage, the fluid source positioned at the first side of the object passage.

4. The apparatus according to claim 3, the apparatus further including a flexible membrane disposed at the second side of the object passage, the sensor device communicating with the flexible membrane to sense movement of the flexible membrane.

5. The apparatus according to claim 4, wherein the sensor device is positioned upon the flexible membrane.

6. The apparatus according to claim 5, wherein when the object is in the obstructing position, the sensed fluid flow decreases resulting in a change in position of the flexible membrane, the sensor device sensing the change in position of the flexible membrane.

7. The apparatus according to claim 4, wherein at least the flexible membrane extends over one end of the fluid passage.

8. The apparatus according to claim 2, wherein the fluid passage includes an inflow passage and an outflow passage, the fluid flow flowing from the fluid source to the object passage through the inflow passage, the fluid flow flowing from the object passage to the sensor device through the outflow passage.

9. The apparatus according to claim 2, wherein the fluid passage is perpendicular to the object passage.

10. The apparatus according to claim 2, wherein the fluid passage intersects the object passage at an acute angle.

11. The apparatus according to claim 1, wherein the fluid source is a fan.

12. The apparatus according to claim 1, wherein the fluid source is a piezoelectric member.

13. The apparatus according to claim 1, wherein the sensor device is a piezoelectric member.

14. A photocopy device including the apparatus that senses at least one of the position, the presence or the absence of the moving object of claim 1.

15. A printer device including the apparatus that senses at least one of the position, the presence or the absence of the moving object of claim 1.

16. A facsimile machine including the apparatus that senses at least one of the position, the presence or the absence of a moving object of claim 1.

17. A document handler including the apparatus that senses at least one of the position, the presence or the absence of a moving object of claim 1.

18. A paper making machine including the apparatus that senses at least one of the position, the presence or the absence of the moving object of claim 1.

19. A sheet metal rolling machine including the apparatus that senses at least one of the position, the presence or the absence of the moving object of claim 1.

20. A conveyor system including the apparatus that senses at least one of the position, the presence or the absence of a moving object of claim 1.

21. A materials transport system including the apparatus that senses at least one of the position, the presence or the absence of a moving object of claim 1.

22. An image forming device, comprising:

an image forming engine;

a recording medium transport system that supplies a recording medium to and removes the recording medium from the image forming engine; and at least one object sensor that detects at least one of the position, a presence or an absence of the recording medium in the paper transport system, the object sensor including:

a housing defining an object passage through which the recording medium is movable;

a fluid source that provides a fluid flow across the object passage;

a sensor device that generates a first signal indicative of an amount of a property at a first time, the property being dependent on an amount of the fluid flow the first signal indicative of a first amount of the fluid flow;

a sensor device that generates a second signal indicative of an amount of a property at a second time, the property being dependent on an amount of the fluid flow, the second signal indicative of a second amount of the fluid flow; and a comparator that compares the first signal and the second signal to determine at least one of the position, the presence or the absence of the recording medium in the paper transport system, wherein, when the recording medium is in an obstructing position relative to the fluid source and the sensor device, the sensed fluid flow decreases.

23. The image forming device of claim 22, wherein the image forming device is a photocopier.

24. The image forming device of claim 22, wherein the image forming device is at least one of a printer, a facsimile machine, or a scanner.

25. The image forming device of claim 22, wherein the at least one object sensor includes a first object sensor and a second object sensor, the first object sensor disposed in the recording medium transport system at a position adjacent to where the recording medium is supplied to the image forming engine, the second object sensor disposed in the recording medium transport system at a position adjacent to where the recording medium is removed from the image forming engine.

26. The image forming device of claim 22, wherein the fluid source in each of the at least one object sensor provides a force to move the recording medium in the recording medium transport system.

27. A method of sensing at least one of a position, a presence, or an absence of a moving object in an object passage, the method comprising:

generating a flow of fluid across the object passage;

sensing a first value of a property at a first time, the property dependent on an amount of fluid flow, the first value indicative of a first amount of the fluid flow;

sensing a second value of the property at a second time, the second value indicative of a second amount of the fluid flow; and comparing the first value and the second value to determine at least one of the position, the presence or the absence of the object relative to the object passage.

28. The method of claim 27, wherein the moving object is a paper sheet.

29. The method of claim 28, wherein generating the flow of fluid comprises passing the flow of fluid through an inflow passage and an outflow passage, the inflow passage providing for a flow of fluid to the obstructing position of the moving object in the object passage, the outflow passage providing for a flow of fluid from the obstructing position of the moving object in the object passage to the flexible membrane.

30. The method of claim 27, wherein both sensing the first value and sensing the second value comprises:

directing the flow of fluid against a flexible membrane;

sensing an amount of deformation of the flexible membrane; and generating a signal indicative of the amount of deformation.

31. The method of claim 30, wherein sensing the amount of deformation of the flexible membrane comprises measuring an amount of strain on a piezoresistive layer integrated with the flexible membrane.

32. The method of claim 30, wherein sensing the amount of deformation of the flexible membrane comprises measuring an amount of strain on a piezoresistive layer attached to the flexible membrane.

33. The method of claim 27, wherein sensing at least one of the position, the presence, or the absence of the moving object in the object passage comprises sensing an arrival of the moving object in the object passage, the comparing step comprising comparing the first value and the second value to determine the arrival of the object relative to a position of the flow of fluid across the object passage.

34. The method of claim 33, wherein comparing the first value to the second value includes generating a signal indicative of arrival of the moving object when the first value is greater than the second value.

35. The method of claim 33, wherein comparing the first value to the second value includes generating a signal indicative of no change when the first value is at most equal to the second value.

36. The method of claim 27, wherein sensing at least one of the position, the presence, or the absence of the moving object in the object passage comprises sensing a departure of the moving object in the object passage, the comparing step comprising comparing the first value and the second value to determine the departure of the object relative to a position of the flow of fluid across the object passage.

37. The method of claim 36, wherein comparing the first value to the second value includes generating a signal indicative of departure of the moving object when the first value is less than the second value.

38. The method of claim 36, wherein comparing the first value to the second value includes generating a signal indicative of no change when the first value is at least equal to the second value.

* * * * *